US005860305A

United States Patent [19]

Castricum

[11] Patent Number: 5,860,305

[45] Date of Patent: Jan. 19, 1999

[54] PIPE CUTTER WITH DUAL OUTER CUTTING KNIVES AND METHOD

[75] Inventor: Wilhelmus P. H. Castricum, Palatine, Ill.

[73] Assignee: Lindab AB, Båstad, Sweden

[21] Appl. No.: 839,584

[22] Filed: Apr. 15, 1997

[51] Int. Cl.[6] ..... B21C 37/12; B21F 11/00

[52] U.S. Cl. ..... 72/49; 72/72; 72/132

[58] Field of Search ..... 72/49, 50, 70, 72/71, 72, 129, 132, 135; 82/56, 57, 82, 92, 98; 83/54, 178, 179, 183, 184

[56] References Cited

U.S. PATENT DOCUMENTS

| | | | |
|---|---|---|---|
| 684,539 | 10/1901 | Cartwright . | |
| 694,524 | 3/1902 | Boyd . | |
| 957,966 | 5/1910 | Jenkins . | |
| 1,345,458 | 7/1920 | Pierce . | |
| 1,372,040 | 3/1921 | Rendano . | |
| 1,478,692 | 12/1923 | Baranoff . | |
| 1,635,807 | 7/1927 | Amberg . | |
| 1,740,430 | 12/1929 | Mudd . | |
| 2,516,817 | 7/1950 | Wernli . | |
| 2,749,983 | 6/1956 | Rogers . | |
| 3,839,931 | 10/1974 | Herpich . | |
| 3,839,933 | 10/1974 | Paramonoff . | |
| 3,913,430 | 10/1975 | van Dijk . | |
| 4,126,064 | 11/1978 | Tarrant | 82/92 |
| 4,292,867 | 10/1981 | Stoffels et al. | 82/98 |
| 4,612,789 | 9/1986 | Andriessen | 72/71 |
| 4,706,481 | 11/1987 | Castricum . | |
| 4,823,579 | 4/1989 | Castricum . | |
| 4,924,684 | 5/1990 | Castricum . | |
| 5,020,351 | 6/1991 | Castricum | 72/49 |
| 5,105,639 | 4/1992 | Castricum . | |
| 5,257,521 | 11/1993 | Castricum . | |
| 5,477,717 | 12/1995 | Skrebergene et al. . | |
| 5,592,741 | 1/1997 | Vassar | 93/178 |
| 5,609,055 | 3/1997 | Castricum . | |
| 5,636,541 | 6/1997 | Castricum . | |

FOREIGN PATENT DOCUMENTS

| | | |
|---|---|---|
| 0 749 787 A1 | 12/1996 | European Pat. Off. . |
| 2218 963 | 2/1974 | France . |
| 8-300216 | 11/1996 | Japan . |
| 718424 | 11/1954 | United Kingdom . |
| 749389 | 5/1956 | United Kingdom . |
| 784289 | 10/1957 | United Kingdom . |

OTHER PUBLICATIONS

International Search Report for PCT/SE 98/00690 mailed Jul. 9, 1998.

*Primary Examiner*—Joseph J. Hail, III
*Assistant Examiner*—Rodney Butler
*Attorney, Agent, or Firm*—Brinks Hofer Gilson & Lione

[57] ABSTRACT

A pipe cutter having dual outer knives and a method of using the same is disclosed. The outer knives are mounted on knife positioners capable of swinging the outer knives into a pipe in an arc to overlap with a knife positioned inside the pipe. The method includes the step of simultaneously swinging the outer knives into a continuously rotating pipe in an arc having a rotational direction opposite the rotational direction of the pipe.

21 Claims, 11 Drawing Sheets

PIPE CUTTER WITH DUAL OUTER CUTTING KNIVES AND METHOD

BACKGROUND OF THE INVENTION

This invention relates to an improved apparatus for producing spirally formed pipe. More particularly this invention relates to a pipe cutting apparatus having dual external cutting knives for cutting spirally formed pipe rapidly and efficiently.

A large potential for small diameter spiral pipes exists in the filter market, such as for use in automobile oil filters. These filters typically have a perforated inner metal cylinder that is approximately one inch in diameter. Because spiral pipes such as those used in oil filters need to be accurately and cleanly cut in large quantities, a pipe forming and cutting apparatus capable of fast and accurate cuts is necessary.

There are several known ways to form and cut a pipe. A pipe may be formed by spirally or helically winding a continuous strip of metal and joining adjacent edges of the wound strip to form a spiral lockseam in the pipe. In some pipe forming and cutting machines, the spirally formed pipe is cut by moving a knife outside the pipe into an overlapping position with a knife inside the pipe. Other types of spiral pipe forming and cutting machines use multiple knives or rotate the knives around the pipe to cut the pipe into sections.

Increased cutting speed in a spiral pipe forming and cutting apparatus is desirable in order to increase pipe production capabilities. One type of pipe cutting machine uses a single rotatable knife in a fixed position with respect to the pipe. The spiral pipe makes a full rotation before a cut is complete using this type of pipe cutting machine. Pipe cutting machines using a knife or knives that rotate around the pipe while cutting are generally more complicated and expensive than pipe cutting machines using fixed knives.

Accordingly, a spiral pipe forming and cutting apparatus is necessary that can improve productivity and sever a continuously formed spiral pipe rapidly and efficiently. Furthermore, a pipe cutting apparatus capable of cutting pipe lengths shorter than the width of the metal strip used to form the spiral is desirable.

SUMMARY OF THE INVENTION

The present invention is directed to an improved apparatus for forming and cutting a spiral pipe. More particularly, the present invention relates to an apparatus capable of cutting spirally formed pipe rapidly and in lengths shorter than the width of the metal strip used to form the spiral pipe According to one aspect of the present invention, a pipe forming and cutting apparatus preferably includes an inner knife positioned inside of a pipe having a cutting edge adjacent an inside circumference of the pipe. A first passively rotatable outer knife is positioned outside of the pipe. The first outer knife is movable from a standby position to a cutting position by a first knife positioner. A second passively rotatable outer knife positioned outside the pipe is located on the opposite side of the pipe as the first outer knife. The second outer knife is movable from a standby position to a cutting position by a second outer knife positioner. The first and second knife positioners are adapted to swing the outer knives into the pipe in an arc having a component that moves in the predetermined rotational direction of the pipe where the outer knives intersect with the pipe. The outer knives pierce the pipe, overlap with the inner knife and cooperate to cut the pipe as the pipe moves axially and rotates between the knives. The rotation of the pipe can help draw the knives into the cutting position. According to another aspect of the invention, the pipe cutting assembly includes a cylindrical sleeve that surrounds the outside of the pipe and has recessed portions defining gaps to allow the outer knives to move into an overlapping position with the inner knife.

The present invention provides significant advantages over conventional methods for making spirally formed pipes, such as longitudinal filter pipes used in automotive oil filters. The cutting process may be completed in half of a rotation with the cutting apparatus of the present invention. The present invention also permits pipe lengths less than the width of the metal strip used to form the spiral pipe to be cut from a continuously moving spirally formed pipe. Additionally, the arcuate motion of the outer knives into the pipe takes advantage of the pipe's rotation to help maintain the knives in a cutting position.

The invention itself, together with further objects and attendant advantages, will be best understood by reference to the following detailed description taken in conjunction with the drawings.

DETAILED DESCRIPTION OF THE PRESENTLY PREFERRED EMBODIMENT

Figure 1:
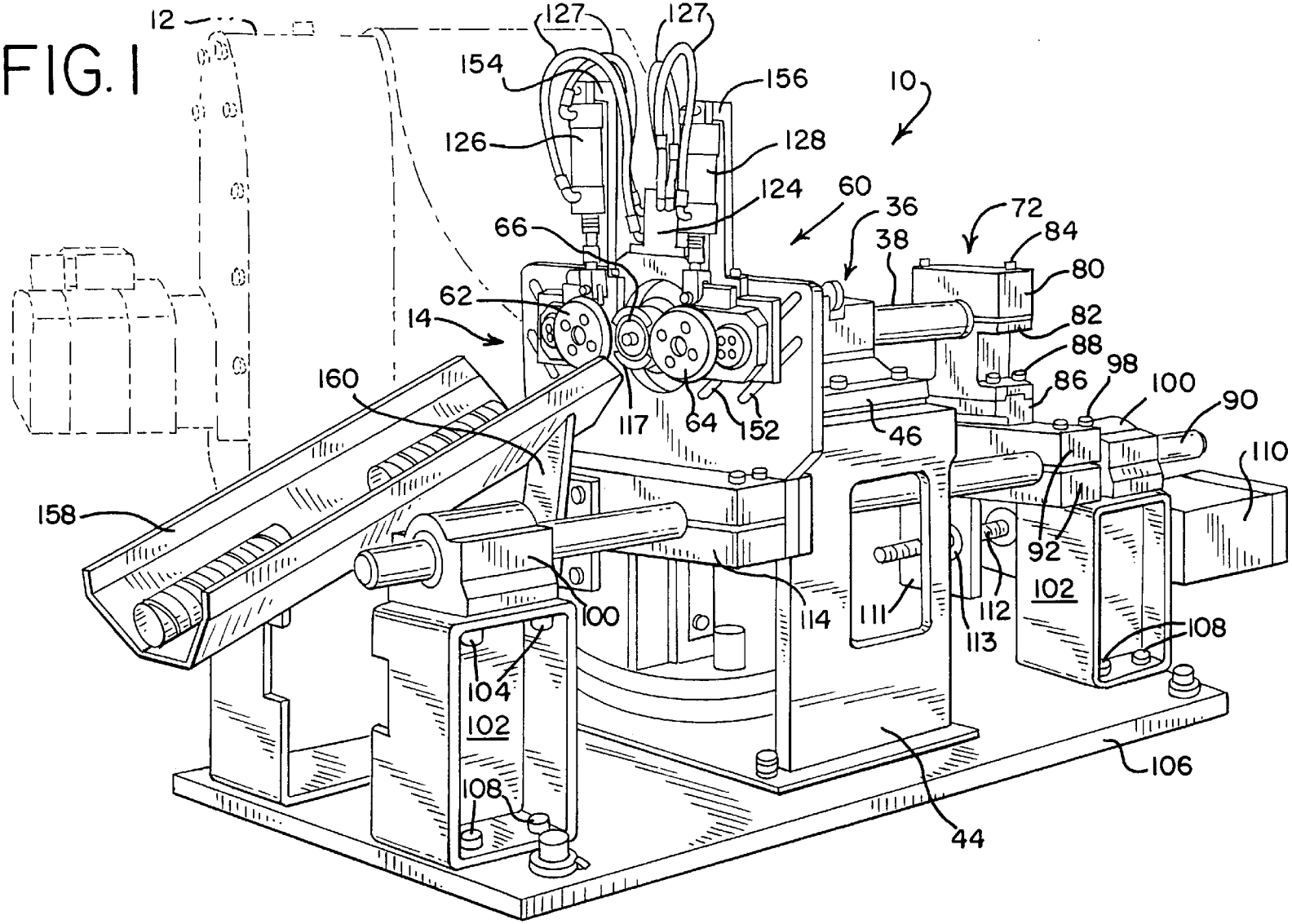
FIG. 1 is a perspective view of a preferred embodiment of the present invention.
Figure 2:
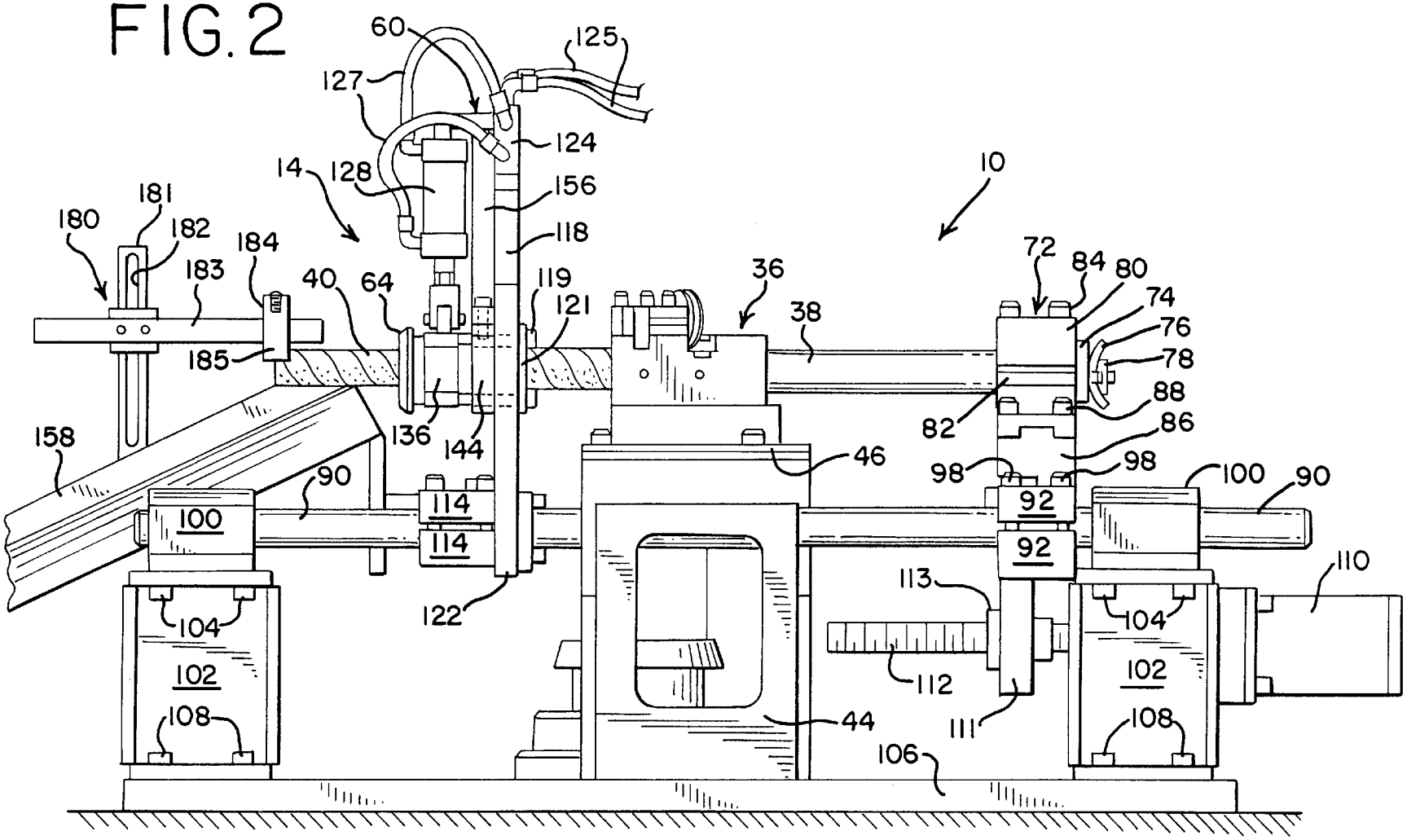
FIG. 2 is a side elevational view of the pipe forming and cutting apparatus of FIG. 1.

FIGS. 1 and 2 show a preferred combination 10 of a spiral pipe forming machine 12 and improved pipe cutting apparatus 14 of the present invention. Many elements of the pipe forming machine 12 are conventional, and are described in greater detail in U.S. Pat. No. 4,924,684 issued May 15, 1990. The entire disclosure of U.S. Pat. No. 4,924,684 is incorporated by reference herein.

Figure 5:
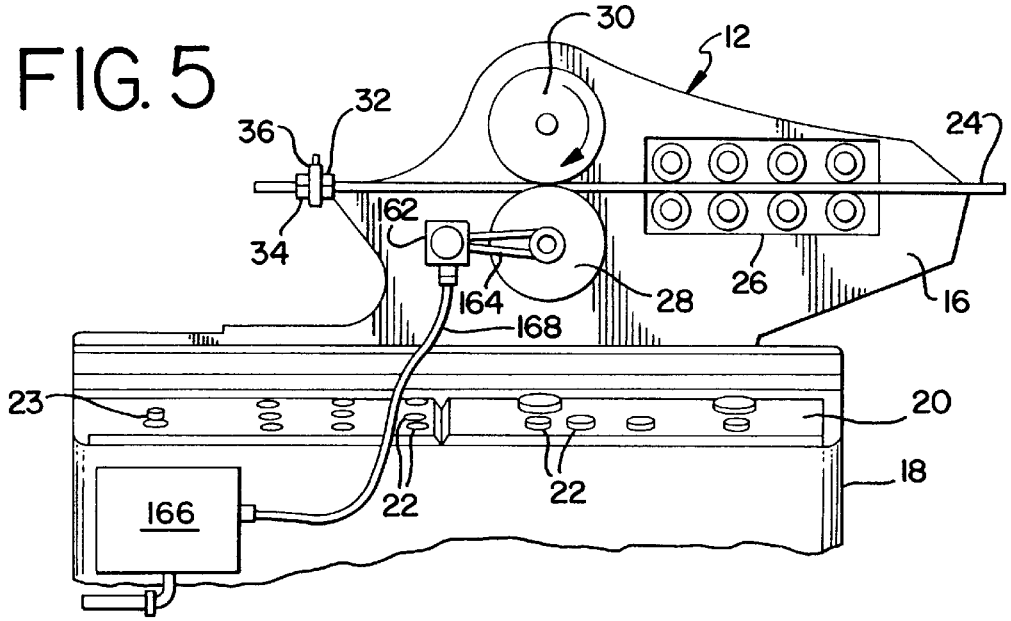
FIG. 5 is a side elevational view of a pipe forming machine suitable for use in the pipe forming and cutting apparatus of FIGS. 1 and 3.

FIG. 5 shows some of the elements of one suitable pipe forming machine 12. The machine includes a frame 16 and a control cabinet 18. A control panel 20 contains a plurality of control elements 22, such as knobs, gauges and dials, for controlling and monitoring the operation of the pipe forming machine 12 and pipe cutting apparatus 14. The functions of a suitable set of control elements are described in U.S. Pat. No. 4,706,481, issued Nov. 17, 1987. The descriptions of the control elements contained in that patent are incorporated by reference herein, and made a part hereof.

A continuous metal strip 24 is fed into the frame 16 of the pipe forming machine 12 to begin the process of forming a spiral pipe having a spiral lockseam. To make one inch diameter filter pipe, the strip 24 is preferably 1.5 inches wide and perforated. The strip 24 can be perforated before entering the pipe forming machine 12, or perforated by a perforating drive roller in the pipe forming machine 12. The present invention is not limited to making perforated filter pipe and may also be modified to produce larger or smaller pipe diameters. If an increased pipe diameter is desired, a wider strip 24 can be used and is preferred.

The metal strip 24 passes through a roller housing 26 containing a plurality of rollers that bend the edges of the strip 24 into a predetermined shape for forming the lockseam. The plurality of rollers may be configured to form corrugation grooves in the metal strip. A lower drive roller 28 and an upper drive roller 30 are rotatably mounted in the frame 16. The drive rollers cooperate to pull the metal strip 24 into the frame 16 and through the roller housing 26. The two drive rollers 28, 30 then push the metal strip 24 between the upper guide plate 32 and lower guide plate 34. The width of the drive rollers 28, 30 and the guide plates 32, 34 may be adapted to conform to the width of the strip 24. The lower guide plate 34 is secured to the frame 16 by bolts. The lower guide plate 34 also contains grooves to accommodate the edges and any corrugations formed in the strip 24. Clamps 36 are pivotally connected to a base that is attached to the frame 16. The clamps 36 hold the upper guide plate 32 against the lower guide plate 34.

The control panel 20 is provided with an on/off switch for the pipe cutting apparatus 14 and one speed adjustment knob 23. The speed adjustment knob 23 allows a user to set a convenient production speed for the pipe forming machine 12. Although the pipe former preferably maintains a constant speed throughout the process of forming and cutting the pipe, the speed adjustment knob is used to aid in the initial set up and calibration of the combination 10 pipe former and cutter. Also, when cutting very short lengths of pipe, the speed adjustment knob is used to set the pipe production speed so that the pipe cutting apparatus 14 has sufficient time to return to the desired starting point for a cut after finishing the previous cutting operation.

Figure 6:
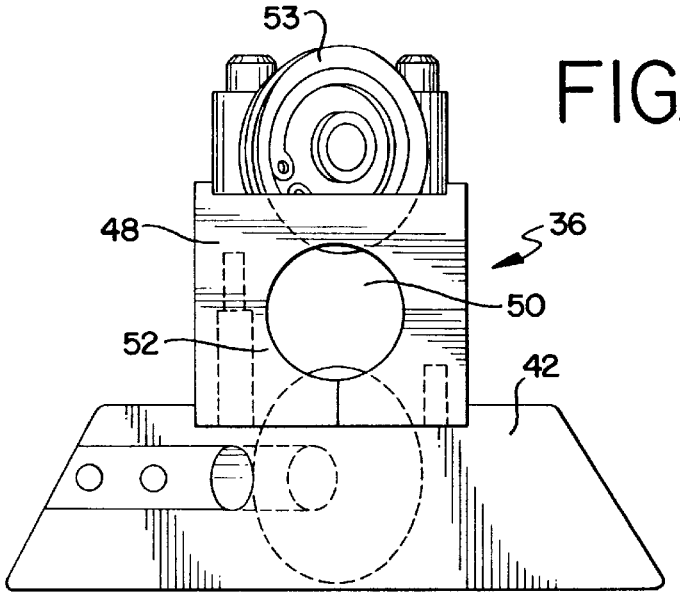
FIG. 6 is a front elevational view of the forming head assembly of the pipe forming and cutting apparatus of FIG. 1.
Figure 7:
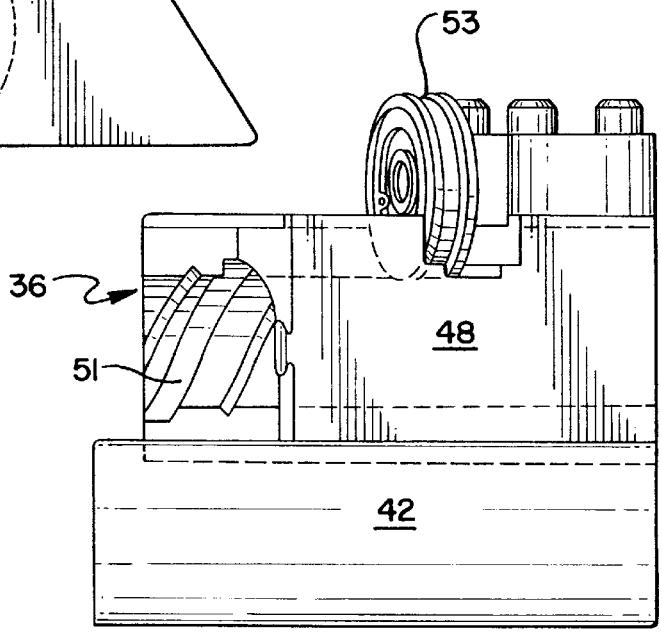
FIG. 7 is a side elevational view of the forming head assembly FIG. 6.

After the continuous metal strip 24 has been shaped in the roller housing 26 and drawn through the upper and lower drive rollers 28, 30, it is guided into a forming head assembly. As best shown in FIG. 2, the forming head assembly 36 and a rotatable mandrel 38 extending through the forming head assembly 36 cooperate to form the metal strip 24 into a spiral pipe 40. Referring also to FIGS. 6 and 7, the forming head assembly 36 includes a base 42 which is detachably secured to a forming head table 44. A clamp 46 is used to secure the forming head base 42 to the forming head table 44. The forming head assembly 36 also includes a forming head 48 which is bolted to the forming head base 42. The forming head 48 encloses a lateral bore 50. The metal strip 24 is formed into a spiral pipe having a predetermined diameter inside of the lateral bore 50. The forming head 48 may have helical grooves 51 to accommodate any corrugations on the helically-wound strip and the spiral pipe 40. Deeper helical grooves are provided for the formed edges of the strip 24 and the resulting lockseam. The inner grooves 51 help guide the helically-wound strip 24 and spiral pipe 40 through the forming head 48. A lockseam roller head 53 protrudes through the top of the forming head 36 and contacts the folded, helically wound strip edges. A suitable forming head is disclosed in U.S. Pat. No. 4,924,684, the entire disclosure of which is incorporated herein by reference.

Interchangeable forming heads with different diameter lateral bores can be used in the present invention. In the embodiment illustrated in FIGS. 1 and 2, the pipe forming and cutting apparatus 10 may be used to make spiral filter pipe one to two inches in diameter from a one and one-half inch wide perforated metal strip 24. It is expected that spiral pipe as small as seven-eighths of an inch (⅞ inch) in diameter can be made using the embodiment of FIGS. 1 and 2. The inner diameter of the lateral bore 50 determines the outer diameter of the spiral pipe 40. When adapting the pipe forming and cutting apparatus to change the diameter of the spiral pipe, a user needs to replace the forming head 48 with another forming head having a different diameter lateral bore 50. The forming head 48 mates with a removable inset 52. The inset 52 is held in place by bolts (not shown). The radius of curvature of the removable inset 52 is smaller than the radius of curvature of the lateral bore 50. The inset 52 and lower clinching roller (not shown) in the forming head work together to form the seam of the spiral pipe.

Referring to FIGS. 1, 2 and 7, the spiral pipe 40 is not only formed inside the enclosed forming head 48, but at the same time is formed around the cylindrical mandrel 38. The clearance between the mandrel 38 and the surface of the lateral bore 50 in the forming head 48 is approximately twice the thickness of the metal strip, +0.006/−0.003 inches each side. The closely controlled clearance between the mandrel 38 and enclosed forming head 48 provides greater accuracy in producing pipe having a consistent diameter. If there is too much clearance, the strip 24 will buckle in the forming head. If there is too little clearance, the strip 24 will lock up inside the forming head.

The mandrel 38 is preferably passively rotatable so that contact with the moving strip of metal causes the mandrel to rotate. The mandrel 38 may be constructed from a solid metal cylinder. An inner knife 66 is fixedly attached to the mandrel such that it rotates in unison with the mandrel. The mandrel 38 and knife 66 are also rotatably driven by the force of the pipe rotating between the overlapping inner knife 66 and outer knives 62, 64 during the cutting process. To provide the passive rotation, the end of the mandrel 38 mounted in a mandrel holder assembly 72 is surrounded by combination needle/thrust bearings (not shown). Suitable needle/thrust bearings may be obtained from IKO Bearings, of Arlington Heights, Ill. The bearings are held in the mandrel holder assembly 72 by an annular support member 74, a lock washer 76, and a lock nut 78.

Figure 3:
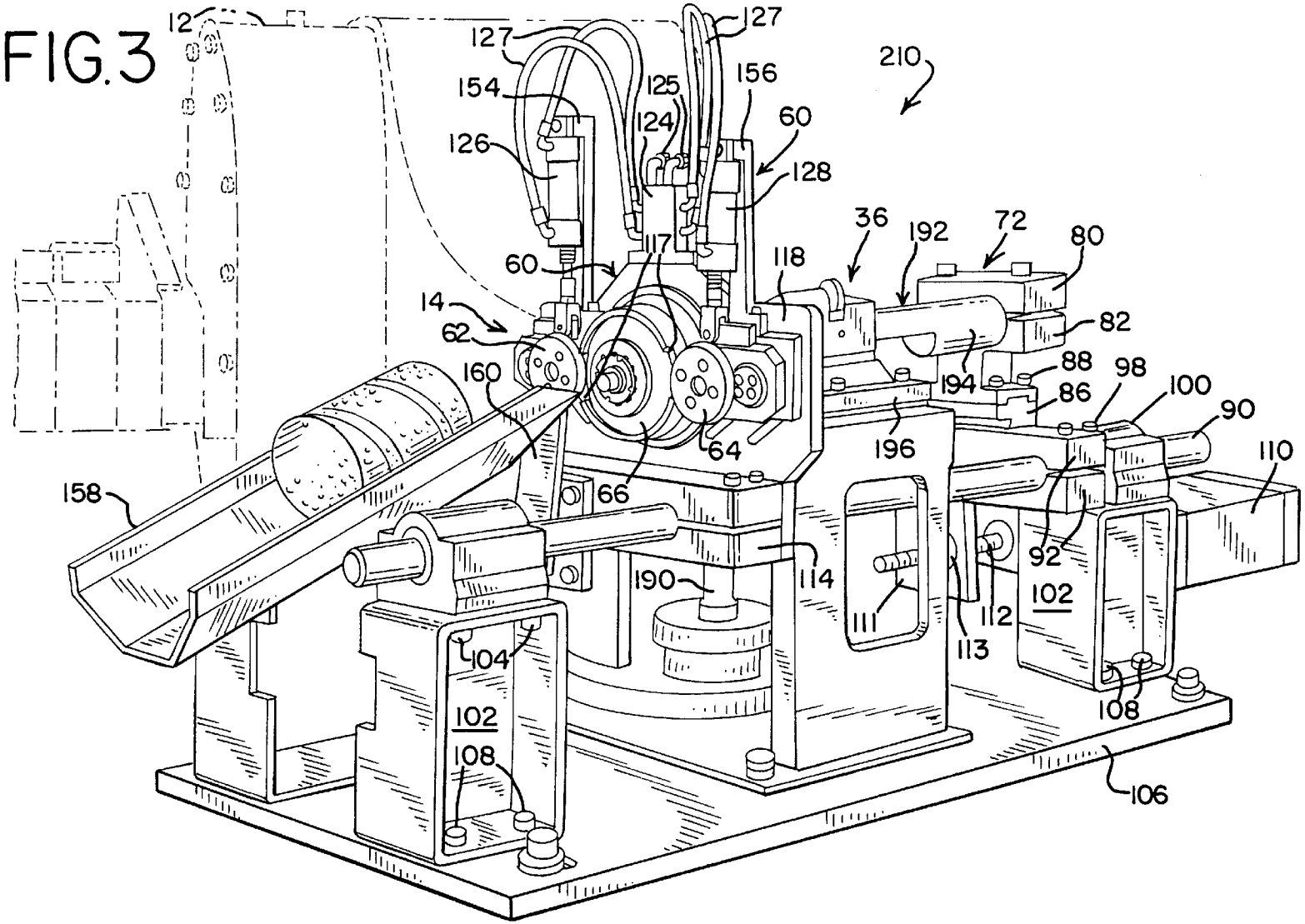
FIG. 3 is a perspective view of a second preferred embodiment of the present invention.
Figure 4:
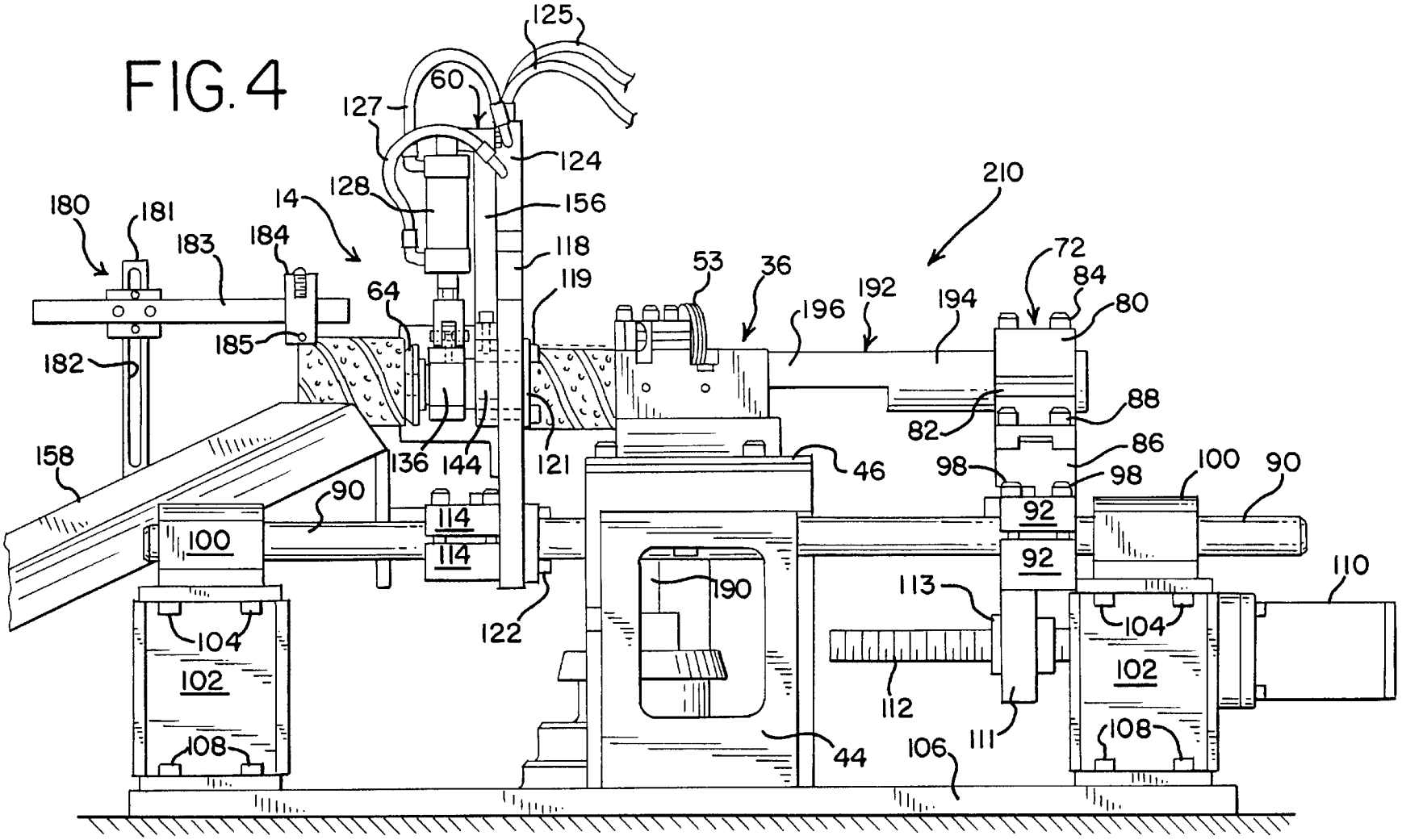
FIG. 4 is a side elevational view of the pipe forming and cutting apparatus of FIG. 3.

FIGS. 3 and 4 illustrate a second preferred embodiment of the pipe cutting apparatus 210. This embodiment incorporates a fixed boom 192 and an external lower clinching roller (not shown) supported on a clinching roller post 190. An internal clinching roller (not shown) cooperates with the external lower clinching roller to clinch together the edges of the metal strip 24 and form the seam of the spiral pipe. The remaining elements of the pipe former and cutter are the same as shown in FIGS. 1 and 2. The embodiment of FIGS. 3 and 4 is suitable for creating spiral pipes with a diameter of more than 1¾ inch. The fixed boom 192 has a cylindrical portion 194 firmly clamped in the mandrel holder assembly 72 and a half round portion 196 that extends through the forming head 36. Although the fixed boom 192 does not rotate, a bearing assembly (not shown) in the inner knife 66 allows the inner knife to passively rotate with the formed pipe during a cutting operation. The inner knife 66 is bolted to the end of the boom and rotates about the bearing assembly Preferably, the bearing assembly is made up of thrust and needle bearings commonly available from IKO Bearings of Arlington Heights, Ill.

Figure 8:
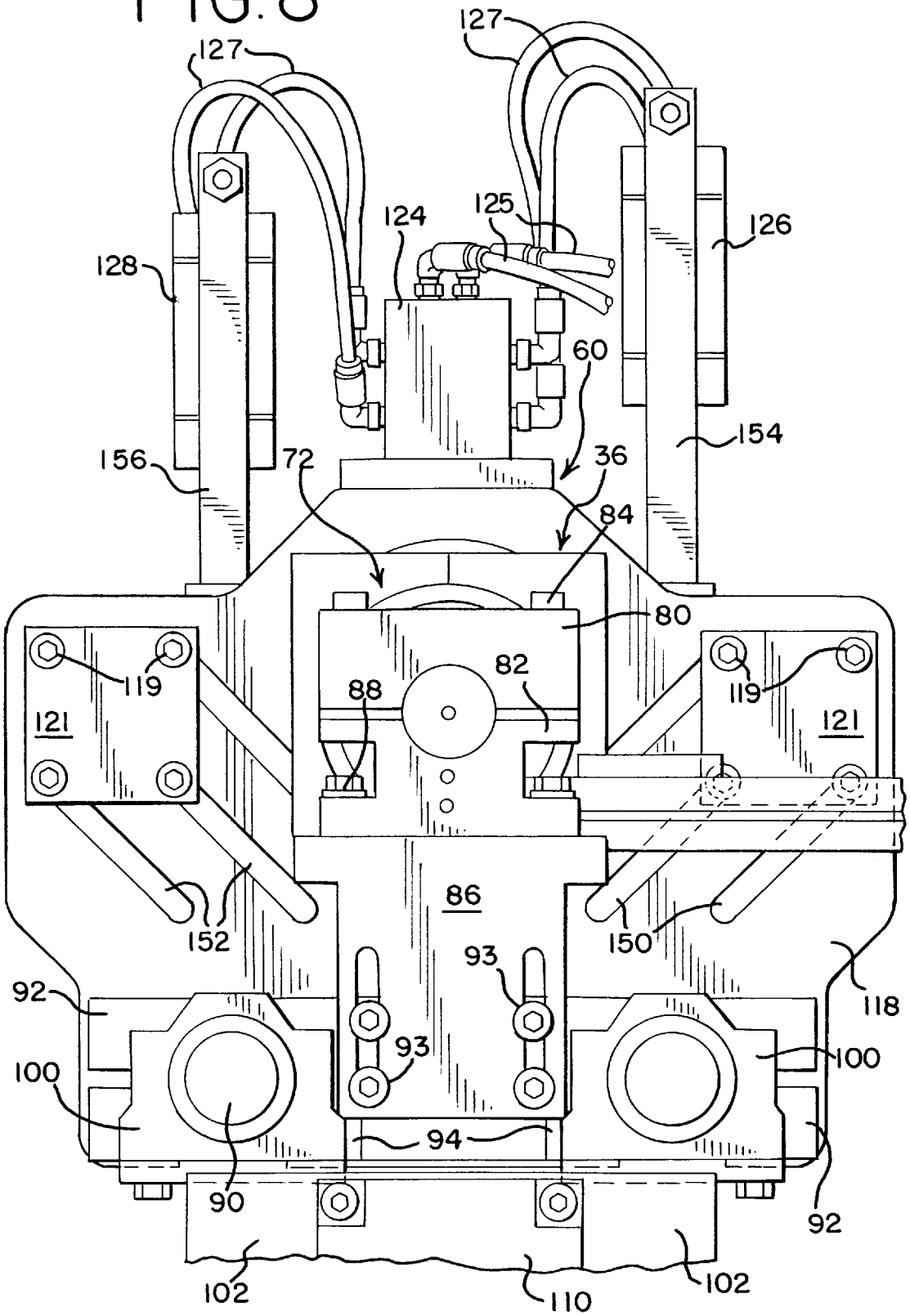
FIG. 8 is a rear elevational view of the pipe forming and cutting apparatus of FIG. 4.
Figure 9:
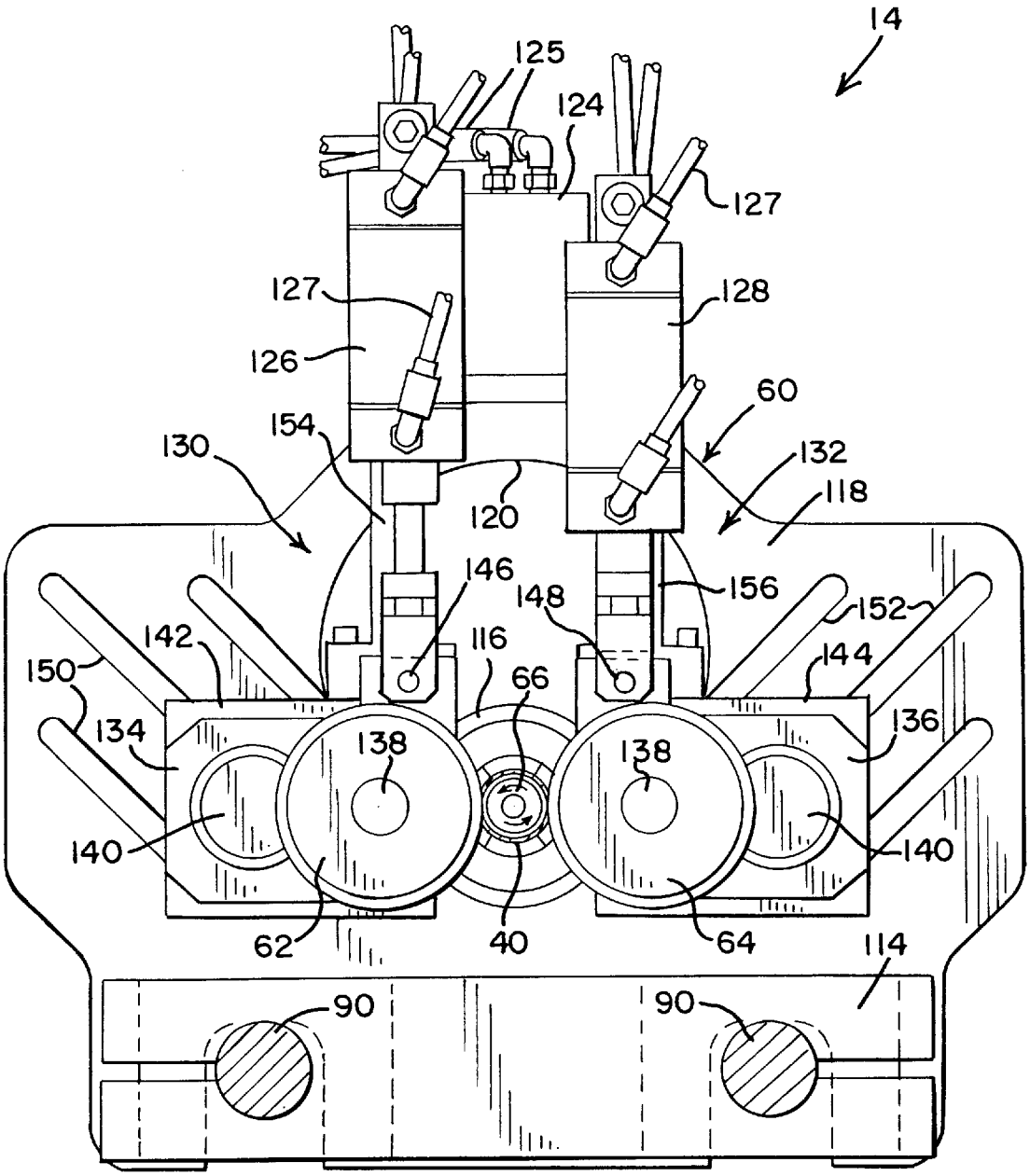
FIG. 9 is a front elevational view of the pipe cutting apparatus shown in the pipe forming and cutting apparatus of FIG. 1 in a cutting position.
Figure 10:
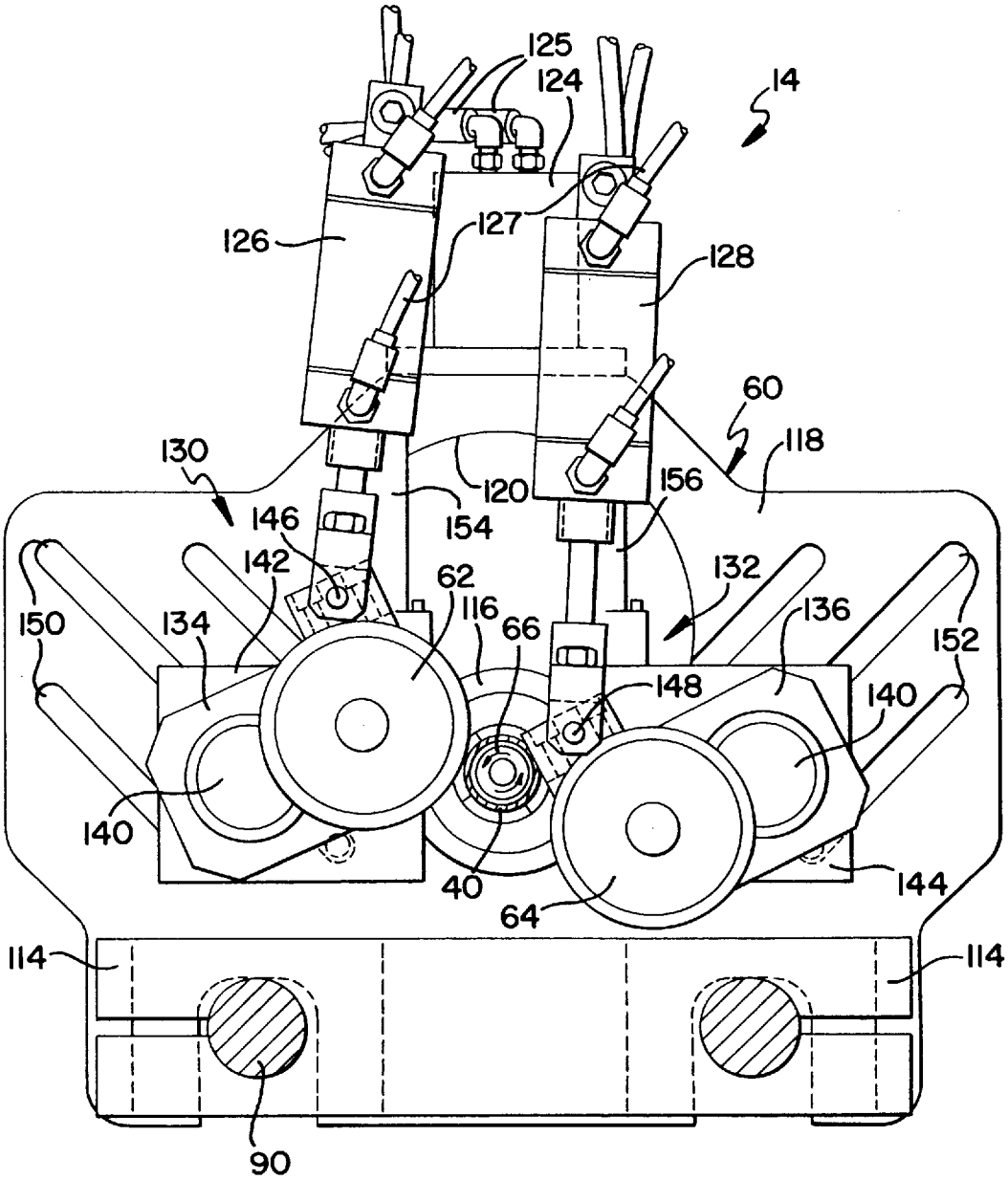
FIG. 10 is a front elevational view of the pipe cutting apparatus of FIG. 9 in a standby position.

Referring again to FIG. 2, spiral pipe continuously emerges from the forming head assembly 36 and proceeds to the pipe cutting apparatus 14 to be cut into desired lengths of pipe. In a preferred embodiment of the present invention, as shown in FIGS. 8–10, a pipe cutting apparatus 14 for cutting the spiral pipe formed with the pipe forming machine 12 includes an outer knife mechanism 60 having two outer knives 62, 64. The outer knives 62, 64 cooperate with the inner knife 66 fixed on the rotatable mandrel 38, or the inner knife 66 rotatably mounted on the fixed boom (FIGS. 3 and 4), extending through the newly formed pipe. When cutting the pipe, the two outer knives 62, 64 overlap the inner knife 66 to puncture the pipe and sever it into sections of predetermined length without slowing or interfering with the continuous pipe forming operation. The presently preferred pipe cutting apparatus 14 includes many elements of the pipe cutting apparatuses disclosed in U.S. Pat. No. 4,706,481 and U.S. Pat. No. 4,924,684. The descriptions of the pipe cutting apparatuses contained in these patents are incorporated by reference herein and made a part hereof.

As shown in FIGS. 1 and 2, the inner knife 66 is rotatably attached to the end of the mandrel 38 with a bolt 70. The inner knife 66 is preferably a circular plate having a sharpened edge along its circumference. The inner knife may be passively rotatable or may be actively driven. The mandrel 38 and inner knife 66 are coaxially aligned with the pipe.

Figure 14:
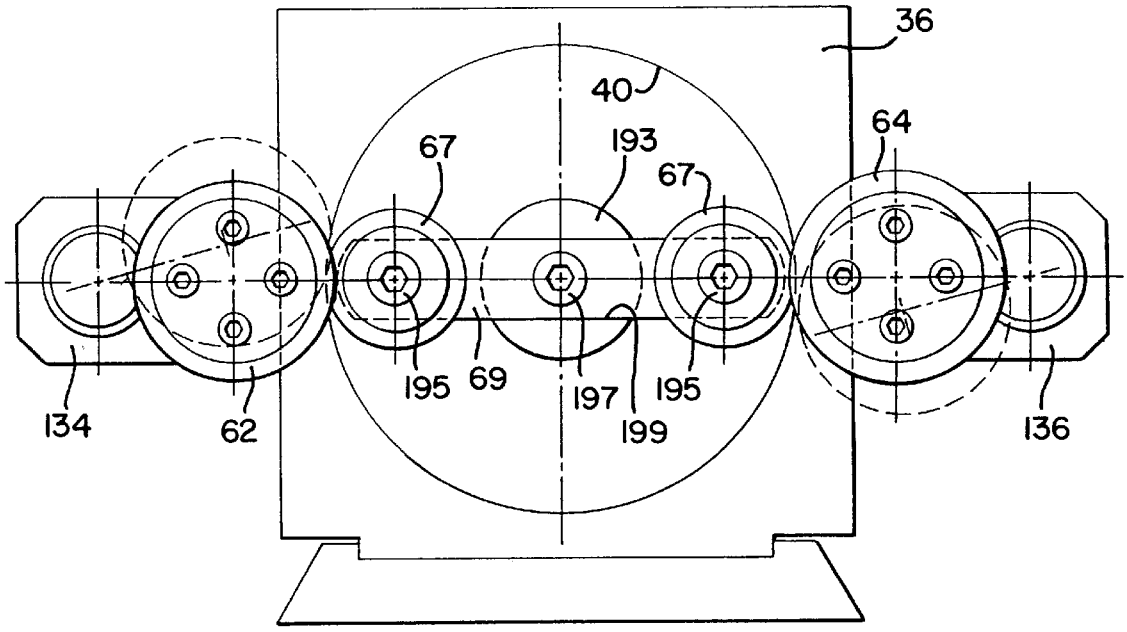
FIG. 14 is a front cutaway view of an alternative embodiment of an inner knife and boom for use in the pipe forming and cutting apparatus of FIGS. 3 and 4.
Figure 15:
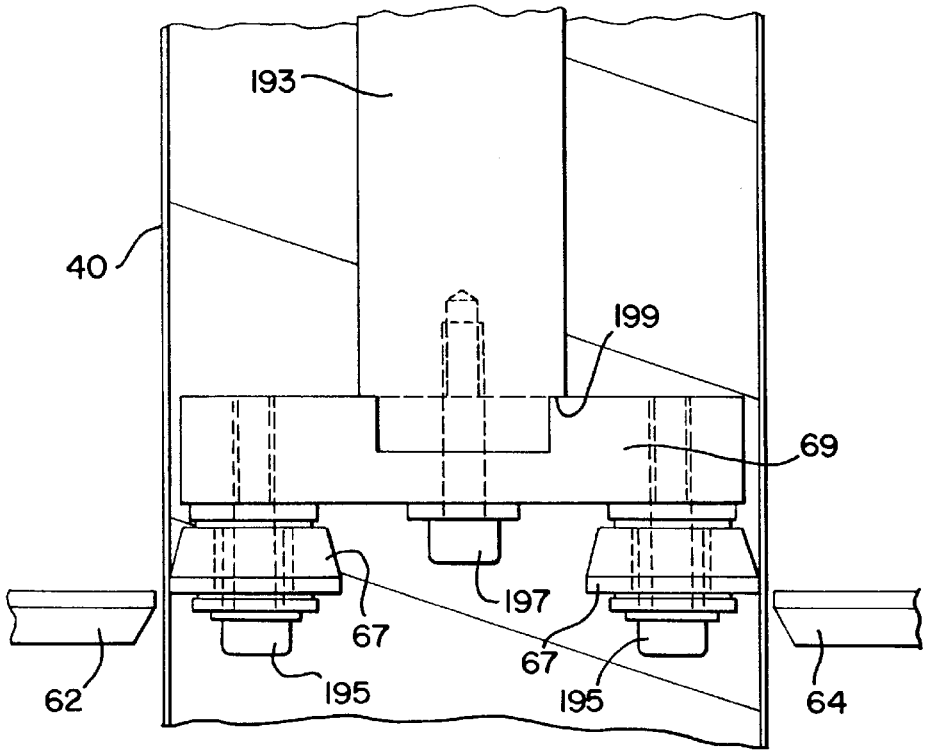
FIG. 15 is a top cutaway view of the inner knife and boom of FIG. 14.

In another preferred embodiment, as shown in FIGS. 14 and 15, the inner knife may comprise a pair of knives 67 that may be positioned inside the pipe 40. This embodiment is best suited for producing larger diameter pipes on the pipe cutter and former 210 of FIGS. 3 and 4 where a boom is used and there is adequate room for a pair of knives on the end of the boom inside the pipe. In this embodiment, each of the inner knives 67 is aligned with a respective outer knife 62, 64. Each of the passively rotatable inner knives 67 may be affixed to opposite ends of a cross-beam 69 attached to a modified boom 193 by a bolt 195. Each inner knife 67 preferably rotates on a bearing assembly. One suitable bearing assembly is the bearing assembly for the outer knives 62, 64 shown in FIG. 11 and described in greater detail below. A different cross-beam 69 may be selected for different diameter pipe so that the same knives can be reused. The cross-beam 69 is fixed with a bolt 197 in a slot 199 extending horizontally across the diameter of the end of the boom 193 so that the cross-beam 69 will not rotate. Another advantage of using two inner knives and replaceable cross-beams is reduction of the weight on the end of the boom as compared to a single large diameter inner knife.

The mandrel holder assembly 72 has an upper section 80 and a lower section 82. Each section has a central semi-cylindrical cavity which abuts the annular support member 74. Alternatively, the upper and lower sections 80, 82 directly clamp on to the end of the cylindrical portion 194 of the fixed boom 192 in the embodiment of FIGS. 3 and 4. The upper section 80 and the lower section 82 are clamped to each other by a plurality of allen bolts 84. The lower section 82 is mounted on an attachment block 86, and fixed thereto by allen bolts 88. The attachment block 86 passes between guide shafts 90, and is adjustably secured to a shaft connector 92 by allen bolts (not shown). A plurality of allen bolts 98 hold the ends of the shaft connector 92 around the guide shafts 90, so that the shaft connector 92 will move with the guide shafts 90. The guide shafts 90 pass through openings in the forming head table 44, and through the bearing housings 100, which include THK Slide Bearing SC 30 assemblies.

There are four such bearing housings 100, each of which is attached to the top of a mounting leg 102 by allen bolts 104. The four mounting legs 102 are provided to support the mandrel 38 and the pipe cutting apparatus 14 at the correct height with respect to the forming head table 44. The mounting legs 102 are attached to a base plate 106 by allen bolts 108. The base plate 106 is preferably attached to the pipe forming machine 12. In order to provide a simple way of adjusting components of the mandrel holder assembly 72 relative to each other, most of the bolts connecting the various components of the mandrel assembly 72 preferably pass through oval slots.

Referring to FIGS. 2 and 8, the attachment block 86 is adjustably fixed by bolts to the shaft connector 92 toward the rear of the apparatus 10. The height of the mandrel 38 may be adjusted by loosening the bolts 93 holding the attachment block in place, and sliding the attachment block up or down in slots 94 provided in the attachment block 86. The mandrel can be adjusted in this manner to set up the combination pipe forming and cutting apparatus 10 for different sized pipe so that the inner knife 66 will be centered in the pipe.

A servo motor 110 attached to a mounting leg 102 drives the guide shafts 90 backwards or forwards in the axial direction of the pipe. The servo motor 110 turns a drive screw 112. The drive screw 112 cooperates with a ball nut assembly 113 mounted in an extension 111 that passes between the guide shafts 90 to controllably slide the guide shafts, including all attached components, during cutting operations. Because the outer knife mechanism 60 is also attached to the guide shaft 90 by shaft connectors 114, the mandrel 38 and attached inner knife 66 move in unison with the outer knife mechanism 60 when the servo motor 110 is activated. The forming head remains fixed on the base plate 106 while the guide shafts 90 move the outer knife assembly and mandrel back and forth during the cutting operation.

A detector assembly 180 is also attached to one of the guide shafts 90. The detector assembly 180 is used to adjust the length of pipe cut by the pipe cutting apparatus 14. The detector assembly 180 includes a vertical support 181 directly attached to the guide shaft with a clamp or a bolt. The vertical support has a central opening 182 along its length that permits adjustment of a horizontal cross bar 183 to a desired height. A bracket 184 is slidably adjustable along the horizontal cross bar 183 to a desirable distance from the outer knives 62, 64. The bracket 184 is preferably a c-shaped bracket holding a light source (not shown) on one side and an optical detector 185 on the other. One suitable optical detector is a fiber optic sensor, part no. E3A2-XCM4T, manufactured by Omron Company of Schaumberg, Ill. The optical detector 185 activates a solenoid valve(not shown) that controls the operation of the outer knife mechanism 60 and to the servo motor 110. As explained in greater detail below, the solenoid valve receives a signal to begin a cut from a microprocessor upon the microprocessor's receipt of a signal from the optical detector 185. The bracket 184 is preferably adjusted such that a forming pipe will pass between the light source and optical detector 185 to trigger the outer knife mechanism 60 and servo motor 110 and begin the cutting operation.

The details of the outer knife mechanism are best shown in FIGS. 9–12. The outer knife mechanism 60 includes first and second outer knives 62, 64 and a guide sleeve 116 mounted on a mounting plate 118. The mounting plate 118 has a cylindrical bore 120 over which the guide sleeve 116 is removably mounted. The mounting plate is connected to the shaft connectors 114 by bolts 122. A manifold 124 is bolted to the mounting plate 118 for controlling the distribution of fluid to the knife operating cylinders 126, 128 on the first and second knife positioners 130, 132. The manifold 124 attaches to the solenoid valve (not shown), such as solenoid valve part no. 0825A431J manufactured by Numatics, via feeder hoses 125.

As described above, the solenoid valve is connected to the optical detector 185 and is triggered when the forming pipe reaches a predetermined length and passes between the light source and optical detector 185 on the detector assembly 180. The fluid in the feeder hoses 125 is distributed and collected in cylinder hoses 127 connecting the manifold to the cylinders 126, 128. Preferably, the cylinders are double action pneumatic cylinders such as the 17-1-DP cylinder manufactured by Bimba, Inc. Other cylinders having a suitably fast response time may also be used. In other preferred embodiments, hydraulic cylinders or electric servo motors may be used.

Spiral pipe 40 to be cut extends through the bore 120 of the mounting plate 118 and is centered inside the guide sleeve 116. The first and second outer knives 62, 64 are positioned on opposite sides of the guide sleeve 116 and outside of the spiral pipe 40. Preferably, the first and second outer knives 62, 64 are each positioned on a separate knife positioner 130, 132. The knife positioners 130, 132 each comprise a pivot arm 134, 136 having a free end connected to the knives 62, 64 by outer knife bearing assemblies 138. The knives are passively rotatable. In another embodiment, a drive mechanism such as a servo motor may actively drive the knives. Pivot arm bearing assemblies 140 rotatably connect the fixed ends of the pivot arms 134, 136 to adjustment blocks 142, 144. The end of each pivot arm 134, 136 that is connected to an outer knife 62, 64 is also connected to a pneumatic cylinder 126, 128 via a pivot point 146, 148.

Figure 11:
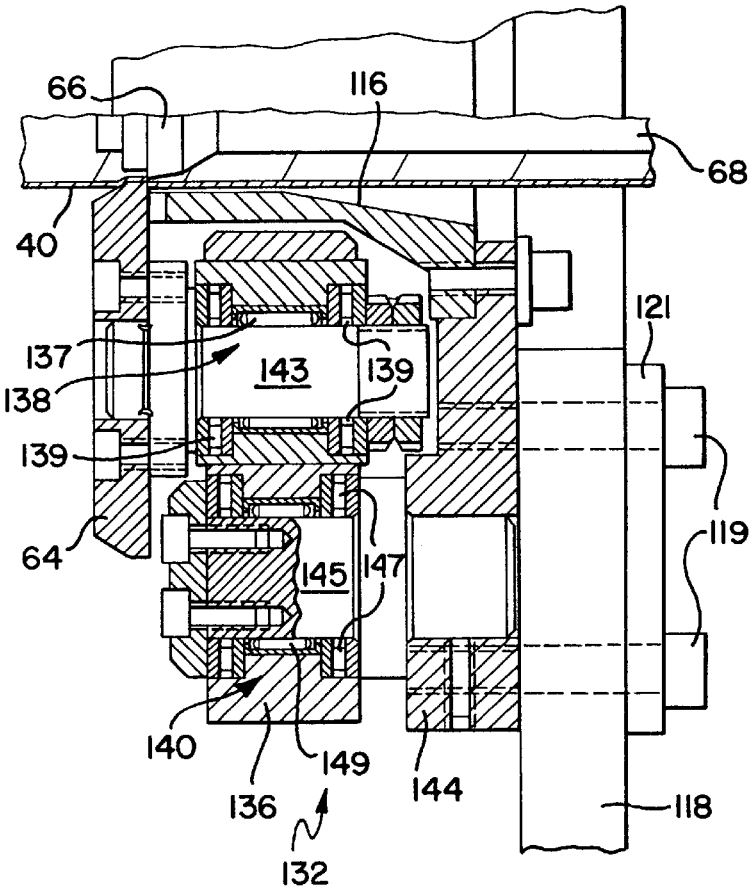
FIG. 11 is a sectional top cross-section view of an outer knife positioner on the pipe cutting apparatus of FIGS. 9 and 10.
Figure 12:
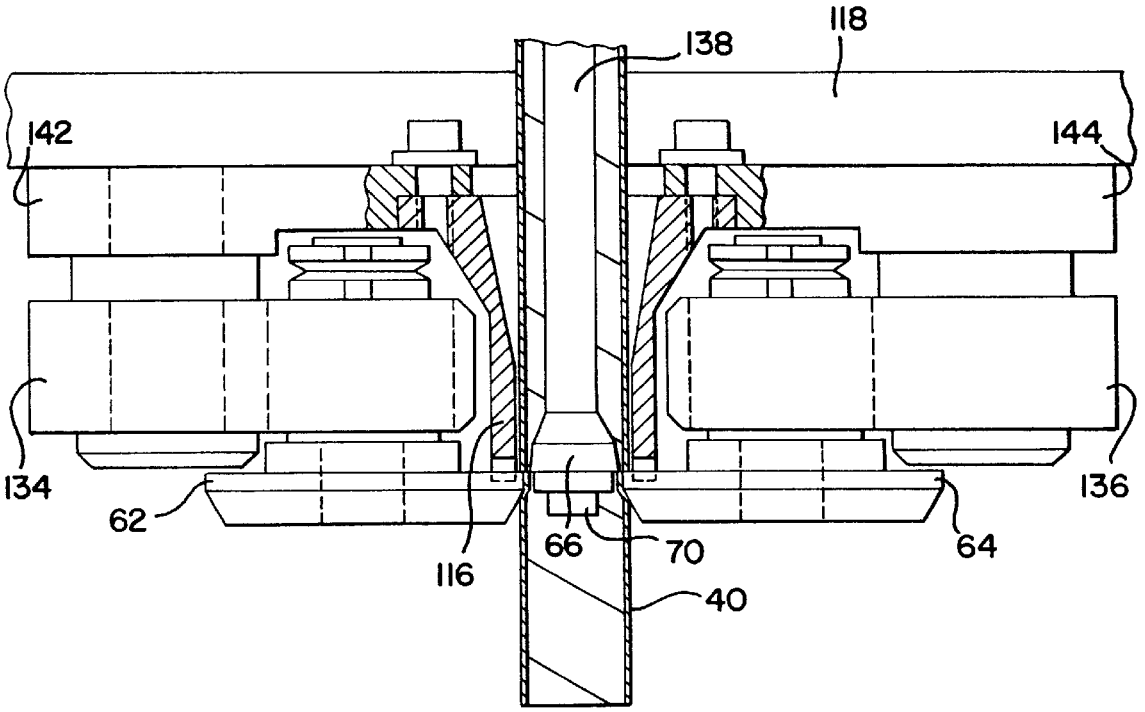
FIG. 12 is a sectional top cross-section view of the cutting apparatus of FIG. 9.

As best shown in FIGS. 11 and 12, the outer knife bearing assemblies 138 and the pivot arm bearing assemblies 140 each comprise a needle bearing 137 positioned between two thrust bearings 139. The needle bearing 137 and thrust bearings 139 on the outer knife bearing assembly 138 surround a cylindrical shaft 143 attached to the knife 62, 64. Preferably, the outer knife bearing assembly 138 is constructed to a tolerance of ±0.0002 inches so that there is essentially no play in the radial direction of the cylindrical shaft 143. The outer knife bearing assembly is tightly held together in the longitudinal direction of the cylindrical shaft by lock nuts.

The pivot arm bearing assemblies 140, having the same tolerances as the outer knife bearing assemblies 138, each surround a pivot arm shaft 145 that connect the pivot arms 134, 136 to the adjustment blocks 142, 144. The pivot arm bearing assemblies also are made up of a pair of thrust bearings 147 positioned on either end of needle bearings 149. The bearing assemblies 138, 140 permit the outer knives 62, 64 and pivot arms 134, 136 to be passively rotatable. Thus, each of the outer knives 62, 64 is preferably rotationally driven by contact with the rotating pipe as it turns in the guide sleeve 116 when the knives are in a cutting position.

The outer knife bearing assembly embodiment shown in FIG. 11 is advantageous in that it creates very little rotational resistance. The force on the pipe, and thus on the pipe former driving the sheet that forms the pipe, is therefore not significantly increased by the rotational resistance of the knives when they are engaged in an overlapping manner with the inner knife 66. Suitable needle bearings and thrust bearings are part nos. TLA2020Z and NTB2035 for the outer knife bearing assemblies 138 and part nos. TLA2516Z and NTB2542 for the pivot arm bearing assemblies 140 available from IKO Bearings of Arlington Heights, Ill.

Each pivot arm 134, 136 pivots about a bearing assembly 140 that has an axis parallel to the longitudinal axis of the mandrel 38 or boom 192. The knife positioners are preferably configured such that the knives 62, 64 on the free ends of the pivot arms 134, 136 trace an arcuate path about the their respective bearing assembly 140 axes that intersects the rotating pipe at a non-perpendicular angle. Additionally, when initiating a cut, the rotational direction of the pivot arms 134, 136 about their respective bearing assembly 140 axes is preferably opposite of the rotational direction of the pipe. Thus, the knives 62, 64 on the ends of the pivot arms pierce the pipe and are moved in the direction of the contacted portion of the rotating pipe when the arcuate path of the pivot arms intersects the pipe 40. The pivot arms preferably reach a cutting position (FIG. 9) that aligns the knives on directly opposite sides of the pipe. The outer knives 62, 64 overlap the inner knife 66 and the pipe is severed in half of a pipe rotation.

The first and second adjustment blocks 142, 144 holding the knife positioners are preferably movably attached to the mounting plate 118 by bolts 119 positioned in first and second sets of angled grooves 150, 152, respectively, in the mounting plate 118. The mounting plate is preferably constructed of aluminum to reduce the weight that the servo motor must be able to move back and forth. The bolts 119 holding the adjustment blocks 142, 144 pass through and tighten against a backplate 121 on the back of the aluminum mounting plate 118 so that the bolt heads do not cause undue wear on the back of the mounting plate. Each of the pistons 128, 128 are connected to the adjustment blocks 142, 144 by piston support struts 154, 156. Each of the knife positioners 130, 132 may be moved by loosening the bolts attached to the adjustment blocks 142, 144 and sliding the adjustment blocks a predetermined distance along the grooves 150, 152 to accommodate for different size pipes. Preferably, the grooves 150, 152 are at a 45 degree angle with the horizontal plane of the outer knife mechanism 60. Additionally, the first set of angled grooves 150 are preferably aligned perpendicular to the second set of angled grooves on opposite sides of the cylindrical bore 120 on the mounting plate 118.

Figure 13:
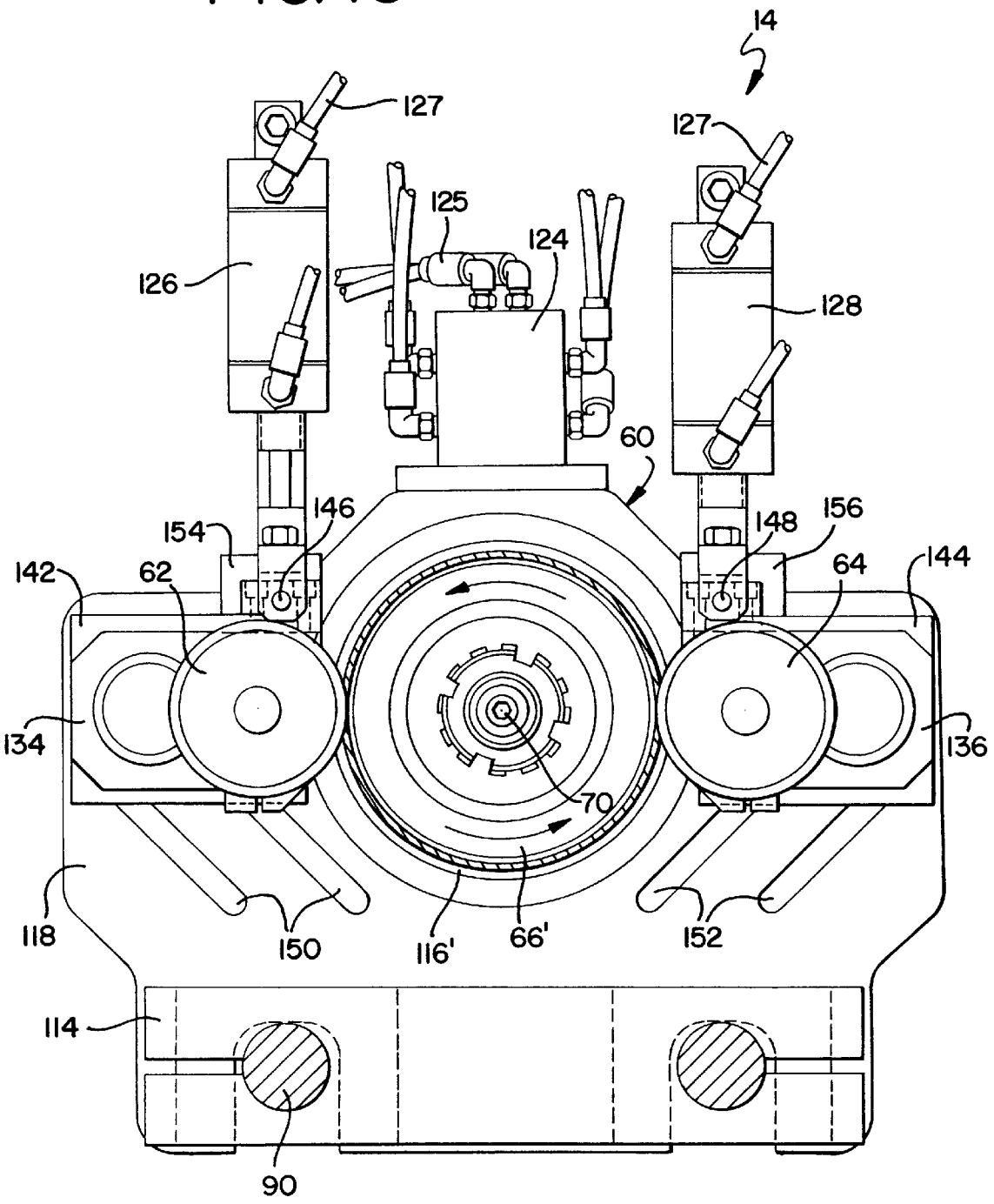
FIG. 13 is a front elevational view of the preferred cutting apparatus configured for cutting a wide diameter pipe.

FIGS. 9 and 13 best illustrate the ability of a user to adjust the outer knife mechanism 60 for cutting different size pipes. As shown in FIG. 9, the knife positioners 130, 132 are affixed to mounting plate 118 in the groves 150, 152 where the grooves come close to each other so that the knives 62, 64 are located close together for cutting small diameter pipe. An inner knife 66 and guide sleeve 116 of the appropriate diameter are fastened to the cutting apparatus 14 by bolts. As shown in FIG. 14, by loosening the bolts holding the adjustment blocks 142, 144, sliding the adjustment blocks away from each other along the angled grooves, and fastening the adjustment blocks at the new location in the grooves, a larger diameter pipe may be accommodated. Only the inner knife 66' and guide sleeve 116' need to be replaced to make this adjustment. An advantage of this design is that the pipe cutting apparatus 14 can be quickly adjusted so that down time is minimized during pipe size changes. Further, the pipe cutting apparatus 14 allows users to adjust for any diameter pipe within a maximum defined by the length of the grooves and the diameter of the cylindrical bore 120 in the mounting plate 118. It may be noted that many of the components of the pipe forming apparatus 10 and slitter apparatus 75 are made of toolsteel (58°–62° HRC), CRS or Mehanite.

A preferred embodiment of the cutting operation of the pipe cutting apparatus 14 is described below. Formed pipe emerging from the forming head assembly continuously rotates and travels axially down the mandrel. The pipe travels through the guide sleeve mounted on the cylindrical bore, over the inner knife attached to the end of the mandrel, and between the outer knives until the leading edge triggers the optical detector 185. The optical detector sends a signal to a microprocessor (not shown) that simultaneously activates the solenoid valve and the servo motor to initiate the cutting process.

The activated solenoid valve feeds a fluid into, and draws fluid from, the feeder hoses 125 connected to the manifold on the outer knife mechanism 60. The manifold divides the fluid between the two cylinders 126, 128 and sends the fluid through the cylinder hoses 127. Prior to initiating the cutting process, the knife positioners 130, 132 hold the outer knives in a standby position. As shown in FIG. 10, the knives are held clear of the pipe 40 to avoid interfering with the ongoing pipe forming process.

When the cutting operation starts, the piston 126 on the first knife positioner 130 extends and the piston 128 on the second knife positioner 132 retracts. The piston movement swings the pivot arms 134, 136 about their respective pivot arm bearing assemblies 140 so that the knives 62, 64 on the pivot arm ends opposite the pivot arm bearing assemblies 140 swing in an arc towards the continuously spinning pipe. The knife positioners 130, 132 each swing their respective knife 62, 64 in an arc that brings the knife into the pipe 40 and also moves the knife in the direction of the contacted portion of rotating pipe. The knives 62, 64 pierce the pipe 40 and overlap the inner knife 66 to achieve a cutting position as shown in FIGS. 9 and 12. Preferably, the adjustment blocks 142, 144 are positioned so that the outer knives 62, 64 sufficiently overlap the inner knife 66 to properly cut the pipe. Additionally, the outer knives are preferably positioned on directly opposite sides of the pipe when in the cutting position so that the pipe is severed in half of a rotation.

The preferred position of the knives when cutting both minimizes the cutting time and reduces stresses on the mandrel 38 or boom 192 (FIGS. 3 and 4). Because the pistons swing the knives into the pipe substantially simultaneously and on directly opposite sides of the pipe, forces perpendicular to the mandrel's longitudinal axis are counterbalanced. Also, the rotational energy of the pipe helps to draw and maintain the outer knives in the cutting position.

A slide 158 is provided to catch pipe sections that have been severed by the pipe cutting apparatus 14. The slide 158 has a vertical flange 160 that is connected to the shaft connector 114 for the mounting plate 118. Thus, the slide 158 also moves in unison with the cutting knives 62, 64, 66 and support sleeve 116 during the cutting operation.

While the knife positioners activate and begin to swing the knives 62, 64 into the pipe, the servo motor 110 has already accelerated the guide shafts to match the axial speed of the formed pipe. The guide shafts 90 move the mandrel 38 and inner knife 66 as well as the entire outer knife mechanism 60 in unison with the formed pipe. The knives can then cleanly overlap and cut the pipe as the pipe rotates. As best shown in FIGS. 2 and 4, the servo motor 110 is attached to a mounting leg 102 and turns a drive shaft 112. The drive shaft preferably connects to a rotatable joint in the lower portion of the rear attachment block 86 that connects to the guide shafts 90 via a shaft connector. The servo motor matches the speed of the pipe when it moves the guide shafts and items attached to the guide shafts.

After the pipe is severed, the servo motor continues moving the guide shafts in the axial direction of the pipe for a short time to allow the knife positioners time to swing the knives 62, 64 clear of the advancing pipe behind the severed section. To bring the knives away from the pipe after a section is severed, the fluid supply to the pistons is reversed so that the first piston 126 retracts and the second piston 128 extends. The pivot arms swing away from the pipe until reaching a preset distance from the pipe. The servo motor then reverses the direction of the drive shaft and draws the guide shafts back to the starting position in preparation for the next cutting operation.

In order to synchronize the longitudinal movement of the cutting assembly 14 with the continuously moving pipe, an electrical encoder is used to monitor the amount of sheet metal that is being used to form the pipe. Referring to FIG. 5, the electrical encoder 162 is coupled to the lower drive roller 28 by a pulley belt 164. The encoder 162 is adapted to generate pulses corresponding to the number of rotations made by the lower drive roller 28. These pulses are transmitted to a control box 166 over a cable 168. The control box 166 preferably contains a microprocessor and memory capable of executing a program for computing the rate that the servo motor 110 needs to move the pipe cutting apparatus 14 based on the rate that the sheet metal strip is fed through the pipe former 12. The control box 44 sends a signal to the solenoid controlling the cylinders 126, 128 on the outer knife mechanism 60 when the pipe has completed one half of a rotation and is completely severed. The knife positioners 130, 132 then swing the knives 62, 64 away from the pipe in a predetermined arc. The control box 166 also sends signals to the servo motor 110 to control the forward speed during a cut and initiate return of the pipe cutting apparatus 14 to an initial position after completion of the cut.

From the foregoing, an improved apparatus for forming and cutting spiral pipe has been described. The apparatus includes an improved pipe cutting apparatus having at least two outer knives positioned on opposite sides of a pipe. The outer knives are mounted on knife positioners that are capable of swinging the knives in an arc. The arc of the knives intersects the circumference of the pipe in a non-orthogonal intersection and allows the outer knives to overlap a knife positioned inside of the pipe and thereby pierce the pipe. The method includes the step of simultaneously swinging the knives into an overlapping position with the inner knife. The knives travel in an arc that is non-perpendicular to the surface of the pipe and arrive at a cutting position on directly opposite sides of the pipe.

It should be understood that changes and modifications to the preferred embodiment described above will be apparent to those skilled in the art. It is intended that the foregoing description be regarded as illustrative rather than limiting, and that it is the following claims, including all equivalents, which are intended to define the scope of the invention.

I claim:

1. A pipe cutting apparatus for cutting a pipe rotating in a predetermined direction, the pipe cutting apparatus comprising:

a passively rotatable inner knife positioned inside the pipe, the inner knife having a cutting edge adjacent to an interior circumference of the pipe;

a first passively rotatable outer knife positioned outside of the pipe, the first outer knife movable from a standby position to a cutting position by a first knife positioner;

a second passively rotatable outer knife positioned outside the pipe and located on an opposite side of the pipe from the first outer knife, the second outer knife movable from a standby position to a cutting position by a second knife positioner, wherein the second knife pierces the pipe and overlaps the inner knife; and wherein the first and second knife positioners are each rotatable about a respective axis that is parallel to a longitudinal axis of the pipe so that the first and second knife positioners swing the first and second outer knives into the pipe in an arc having a rotational direction opposite the predetermined rotational direction of the pipe, whereby the first and second knives are assisted in reaching the cutting position by the rotation of the pipe.

2. The pipe cutting apparatus of claim 1 further comprising a guide sleeve coaxial with the pipe and the inner knife, the guide sleeve surrounding the pipe.

3. The pipe cutting apparatus of claim 1, wherein the first and second knife positioners comprise first and second pivot arms, respectively.

4. The pipe cutting apparatus of claim 1, wherein the first and second knife positioners each comprise a pneumatic cylinder assembly.

5. The pipe cutting apparatus of claim 1, wherein the first and second knife positioners each further comprise an adjustment block movably attached to a mounting plate, wherein each adjustment block is moveable in a plane perpendicular to an axis of the pipe for adjusting the outer knives to accommodate different size pipe.

6. The pipe cutting apparatus of claim 2, wherein the guide sleeve further comprises first and second recessed regions on an end of the guide sleeve, the recessed regions defining openings for receiving the first and second outer knives, whereby the outer knives have access to the pipe.

7. The pipe cutting apparatus of claim 2, wherein the guide sleeve is detachable from the pipe cutting apparatus to accommodate different size pipe.

8. The pipe cutting apparatus of claim 3, wherein the first and second outer knives are rotatably mounted on the first and second pivot arms.

9. The pipe cutting apparatus of claim 5, wherein the mounting plate further comprises at least one groove positioned on each of opposite sides of a central opening in the mounting plate, the grooves for receiving a connector attached to each of the first and second adjustment blocks wherein the adjustment blocks are moveable in predetermined directions to adjust for cutting different size pipes.

10. The pipe cutting apparatus of claim 9, wherein each of the grooves is oriented at a 45° angle with respect to a horizontal plane perpendicular to an axis of the pipe.

11. A pipe cutting apparatus for cutting spirally formed pipe, wherein the pipe continuously moves in an axial direction and rotates while being cut, comprising:

an inner knife positioned inside the pipe;

a guide sleeve coaxial with the pipe and positioned outside of the pipe;

a first outer knife positioned outside the pipe and movable from a standby position to a cutting position, the first outer knife piercing the pipe and overlapping the inner knife when in the cutting position;

a second outer knife positioned outside the pipe and opposite the first outer knife, the second outer knife piercing the pipe and overlapping the inner knife when in the cutting position;

a mounting plate connected to the guide sleeve;

first and second knife positioners attached to the mounting plate, each knife positioner comprising:

an adjustment block attached to the mounting plate, the adjustment block rotatably coupled to a fixed end of a pivot arm by a rotating joint;

the pivot arm having a free end, wherein the free end defines an outer knife bearing for rotatably connecting to an outer knife, and a piston connector; and a piston support strut connecting a piston to the adjustment block and to the piston connector.

12. The pipe cutting apparatus of claim 11, wherein the adjustment blocks are movably attached to the mounting plate for adjusting the outer knives to accommodate different size pipe.

13. The pipe cutting apparatus of claim 12, wherein the mounting plate defines a central bore, the mounting plate having at least one groove on opposite sides of the bore, each of the grooves for receiving a connector attached to the adjustment block wherein the adjustment block is moveable in a predetermined direction to adjust for cutting different size pipes.

14. The pipe cutting apparatus of claim 13, wherein the grooves are oriented at a 45° angle with respect to a horizontal plane perpendicular to an axis of the pipe.

15. A method for cutting a continuously rotating spirally-formed pipe that is moving at a predetermined speed in an axial direction, wherein the pipe is formed from a strip of metal, comprising the steps of:

providing a pipe cutting apparatus having an inner knife positioned inside the pipe, the inner knife having a cutting edge adjacent to an interior circumference of the pipe, a first passively rotatable outer knife positioned on a pivot arm connected to a first knife positioner outside of the pipe, a second passively rotatable outer knife positioned on a second pivot arm outside the pipe and connected to a second knife positioner;

moving the first passively rotatable outer knife in an arc about a first axis that is parallel to a longitudinal axis of the pipe from a standby position to a cutting position wherein the first knife positioner moves the first outer knife into an overlapping position with respect to the inner knife in an arc having a rotational direction opposite of the predetermined rotational direction with the pipe and; and moving the second passively rotatable outer knife in an arc about a second axis that is parallel to a longitudinal axis of the pipe from a standby position to a cutting position wherein the second knife positioner moves the second outer knife into an overlapping position with respect to the inner knife in an arc having a rotational direction opposite the predetermined rotational direction of the pipe.

16. The method of claim 15 further comprising the steps of:

moving the first and second outer knives in the axial direction with the pipe at the same predetermined speed as the pipe; and retracting the first and second outer knives from the cutting position to a standby position after one half of a complete rotation of the pipe, whereby the pipe is cleanly severed.

17. The method of claim 15, wherein the first passively rotatable outer knife is attached to a free end of the first pivot arm, the second passively rotatable outer knife is attached to a free end of the second pivot arm, and the step of moving the outer knives from a standby position to a cutting position comprises moving the free end of the first pivot arm in an arcuate motion into the pipe and simultaneously moving the free end of the second pivot arm in an arcuate motion into the pipe whereby the first and second outer knives pierce the pipe and overlap the inner knife on opposite sides of the pipe.

18. The method of claim 17 wherein the step of moving the free end of the first pivot arm comprises operating a first pneumatic piston operatively attached to the free end of the first pivot arm to move the first pivot arm in an arc and the step of moving the free end of the second pivot arm comprises operating a second pneumatic piston operatively attached to the free end of the second pivot arm to move the second pivot arm in an arc.

19. A pipe cutting apparatus for cutting a pipe continuously moving in an axial direction and rotating in a predetermined direction, the pipe cutting apparatus comprising:

a pair of inner knives positioned inside the pipe, each of the pair of inner knives positioned on opposite sides of an interior circumference of the pipe and each of the pair of inner knives having a cutting edge adjacent to the interior circumference of the pipe;

a first rotatable outer knife positioned outside of the pipe, the first outer knife movable from a standby position to a cutting position by a first knife positioner;

a second rotatable outer knife positioned outside the pipe and located on an opposite side of the pipe from the first outer knife, the second outer knife movable from a standby position to a cutting position by a second knife positioner; and wherein the first and second knife positioners are adapted to swing the first and second outer knives into the pipe in an arc having a rotational direction opposite of the predetermined rotational direction of the pipe, whereby the first and second knives are assisted in reaching the cutting position by the rotation of the pipe.

20. The pipe cutting apparatus of claim 19, wherein the pair of inner knives are attached to a cross-beam mounted on an end of a fixed boom.

21. A pipe cutting apparatus for cutting a pipe continuously moving in an axial direction and rotating in a predetermined direction, the pipe cutting apparatus comprising:

an inner knife positioned inside the pipe and having a cutting edge adjacent to an interior circumference of the pipe;

a first rotatable outer knife positioned outside of the pipe, the first outer knife movable from a standby position to a cutting position by a first knife positioner;

a second rotatable outer knife positioned outside the pipe and located on an opposite side of the pipe from the first outer knife, the second outer knife movable from a standby position to a cutting position by a second knife positioner; and wherein the first and second knives are each rotatably mounted in a knife bearing assembly, each knife bearing assembly comprising:

a needle bearing positioned around a shaft;

a first thrust bearing positioned around a first end of the shaft and adjacent the needle bearing;

a second thrust bearing positioned around a second end of the shaft and adjacent the needle bearing; and wherein the needle bearings and the first and second thrust bearings held together in an axial direction by lock nuts positioned on the ends of the shaft.

* * * * *